United States Patent [19]

Kern et al.

[11] 4,219,983

[45] Sep. 2, 1980

[54] HEAT-INSULATED STRUCTURAL SECTION ASSEMBLY

[75] Inventors: Horstmar Kern; Helmut Botzenhardt, both of Ulm, Fed. Rep. of Germany

[73] Assignee: Wieland-Werke Aktiengesellschaft, Ulm, Fed. Rep. of Germany

[21] Appl. No.: 967,456

[22] Filed: Dec. 7, 1978

[30] Foreign Application Priority Data

Dec. 14, 1977 [DE] Fed. Rep. of Germany ..... 2755695

[51] Int. Cl.[3] ..... E04C 3/30

[52] U.S. Cl. ..... 52/730; 49/DIG. 1

[58] Field of Search ..... 52/730–732, 52/347, 398, 403; 49/DIG. 1; 29/155 R

[56] References Cited

U.S. PATENT DOCUMENTS

| | | | |
|---|---|---|---|
| 3,823,524 | 7/1974 | Weinstein | 52/403 |
| 4,096,678 | 6/1978 | Diels et al. | 52/403 |

FOREIGN PATENT DOCUMENTS

| | | | |
|---|---|---|---|
| 2558635 | 7/1977 | Fed. Rep. of Germany | 52/730 |

*Primary Examiner*—James L. Ridgill, Jr.
*Attorney, Agent, or Firm*—Ladas & Parry

[57] ABSTRACT

This invention relates to heat-insulated structural section assemblies for use in window and door frames. There is disclosed a structural section assembly consisting of an inner and an outer structural metal section, connected to each other by at least one plastic heat-insulating bar held in longitudinally extending opposed grooves of said structural metal sections, and at least one leg integral with one of said structural sections and extending generally parallel to the plane defined by the panel of the window or door frame. Said leg extends from the end of a flange partially defining the groove in said one structural section and said groove-defining flange being forced under pressure onto said heat-insulating bar, said groove-defining flange having a thickened portion which extends the entire length of the assembly on its upper surface facing away from said heat-insulating bar so as to prevent the pressure roller from forming notches in the flange or leg.

1 Claim, 1 Drawing Figure

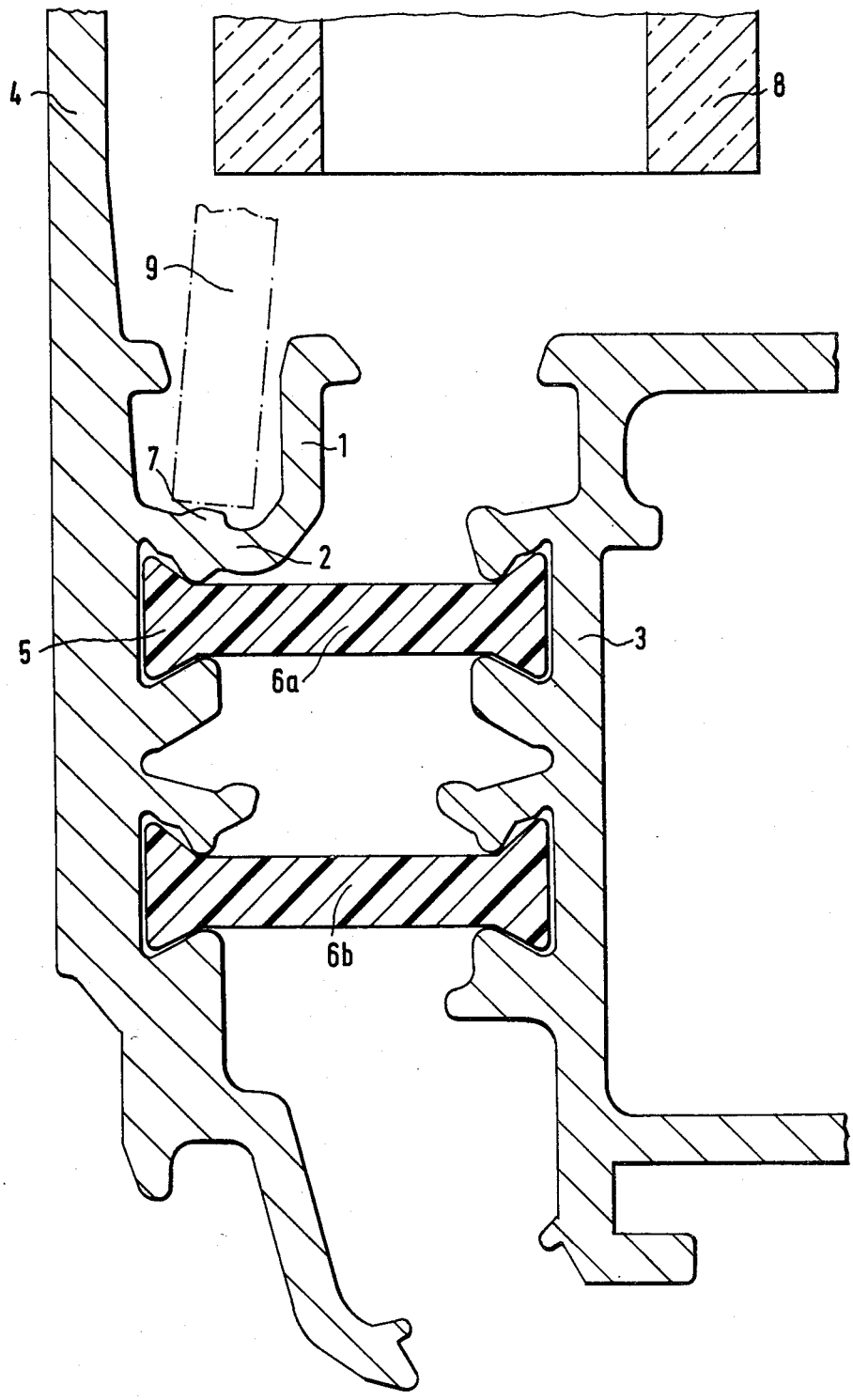
4
8
9
1
7
2
5
3
6a
6b

HEAT-INSULATED STRUCTURAL SECTION ASSEMBLY

BACKGROUND OF THE INVENTION

This invention relates to a heat-insulated structural section assembly for window or door frame, which consists of an inner and an outer structural metal section, connected to each other by at least one plastic heat-insulating bar held in longitudinally extending opposed grooves in said structural metal sections. At least one leg is integral with one of said structural sections and extends generally parallel to the plane defined by the window or door panel. In such assembly, said at least one leg extends from the end of a flange partially defining the groove of said one structural section and the groove defining flange is forced under pressure onto at least one heat-insulating bar.

DESCRIPTION OF THE PRIOR ART

A structural section assembly of the above type is disclosed in "Bauen mit Aluminium 1977", Aluminium-Verlag GmbH, Düsseldorf, West Germany, p.59, 2. which shows an upper and a righthand view of the assembly. The assembly is made by introducing a foamable plastic material between the plastic bars disposed in the opposite grooves of the respective metal structural sections, and then by foaming the plastic material. Thus, complex clamping and foaming devices are required.

German Patent Application No. 2,559,599 discloses a structural section assembly wherein a small space or inner chamber is provided between the two plastic bars. Although this assembly is more easily manufactured, the groove-defining flange must be bent and pressed by rolling from an inner chamber which is defined by the two plastic bars and the two structural metal sections. In addition, the rolling tool must have a strength corresponding to the weakness of the small inner chamber, so that it is difficult to make and it must be frequently repaired. The rolling pressure acts from the inner chamber, so that any manufacturing tolerances of the plastic bars and structural metal sections can become added to each other, possibly resulting in an unuseable structural section assembly.

The structural section assembly of first mentioned prior art is not made from the inner chamber but rather by pressing the groove-defining flange onto the plastic bars from outside, thus the pressure roller is applied at the location of the structural metal section where the deformation takes place. Therefore, notches are formed in the groove-defining flange and in the leg which extends from its terminal end. These notches prevent the leg from remaining in a sufficiently high position because the leg can break at said location. Depending upon the position of the tolerance zones of the groove-defining flange and leg, it may also occur during the rolling step, that the leg be so deformed that it does not reach said tolerance zone position required for unuseability of the finished structural section assembly.

Another structural section assembly of the same type is disclosed in German Patent Application No. 2,221,179. However, the assembly should be so constructed that the groove-defining flanges are set by a rolling process onto the heat-insulating bars, so that the pressure rollers leave corresponding notches in the groove-defining flanges. These notches are undesirable, particularly because cracks can develop from the notches under alternate bending stresses on the finished structural section assembly, which would make the assembly unuseable.

OBJECT OF THE INVENTION

The object of this invention is to provide a structural section assembly of the above-described type in which the indicated drawbacks are overcome which can be manufactured without notches.

SUMMARY OF THE INVENTION

In accordance with the invention, this object is achieved in that the groove-defining flange has a thickened portion on its upper surface facing away from the insulating bar, which extends all the entire length of the structural section assembly. Due to the presence of this thickened portion, the pressure roller cannot form notches in the groove-defining flange or leg since it can apply pressure only onto the thickened portion and the groove-defining flange.

Although German Patent Application No. 2,559,599 does teach thickened portions on groove-defining flanges, such thickened portions partially do not extend along the length of the structural section assembly and are interrupted in the transverse direction to allow some material flow in the direction of further interruptions which are provided in the plastic bar thereunder. In addition, although the above reference does teach continuous thickened portions extending along the longitudinal direction of the structural section assembly on the groove-defining flange, such thickened portions cannot make obvious the concept of the present invention, since they are not disposed on a groove-defining flange to which a leg extending generally parallel to the window glazing or door panel is integrally attached.

In a preferred embodiment of the invention, the thickened portion is convex dome-shaped. Due to such shape, notches cannot be imprinted in the flange or leg during the initial step of the rolling process.

The thickened portions are produced quite simply by slightly modifying the conventional extrusion die used to manufacture the metal structural section so as to be integrally formed therewith.

The metal structural sections are made of any lightweight metal or alloy suitable for window or door frames, preferably aluminum or aluminum alloy.

The heat-insulating bars are made of any plastic material having good heat-insulating characteristics, e.g. polyamides. Such materials are well known by men skilled in the art.

The invention will be now further described by way of a preferred embodiment thereof illustrated in the accompanying drawing.

BRIEF DESCRIPTION OF THE DRAWING

The only FIGURE of the drawing shows a cross-sectional view of a finished structural section assembly of the invention.

DETAILED DESCRIPTION OF THE DRAWING

In the drawing 1, the structural section assembly is shown in association with a window pane 8. It should be understood that the window pane 8 is not actually in position during the rolling process, i.e. at the time when a pressure roller 9 (shown in dotted lines) engages the flange 2. In fact, the window pane 8 is set only in the finished window frame.

The structural section assembly (shown) comprises an inner structural metal section 3, an outer structural metal section 4, and a pair of insulating bars *6a, 6b,* the longitudinal sides of which are swallow-tailed in cross-section. On the outer structural section 4 is disposed a flange 2 which terminates in a leg 1, partially defining a groove. The leg 1 is adapted to receive gaskets and glazing beads (not shown). The pressure roller 9 is used to force the groove-defining flange 2 and the leg 1 onto the insulating bar *6a.* In the FIGURE, the axis (not shown) of the roller 9 is very slightly inclined to the horizontal direction. Due to the presence of a thickened portion 7, notches cannot be formed by the roller 9 in the groove-defining flange 2 or the leg 1 during the rolling process. The thickened portion 7 is preferably convex dome-shaped.

Before the rolling step, the leg 1 and the groove-defining flange 2 are in a raised position. Thus, due to the presence of the thickened portion 7, notches cannot be formed in the groove-defining flange 2 when the rolling process begins, i.e. when the flange 2 and the leg 1 are still in their raised position.

A further advantage of the invention is that any undesired vertical misadjustment of the pressure roller 9 during the rolling process cannot have any substantial effect on the force with which the groove-defining flange 2 is forced onto the bar *6a.* While in the absence of the thickened portion 7, a pressure roller 9 which would be applied only slightly too deeply would cause excessive pressure on the groove-defining flange 2, the thickened portion 7 of the invention permits the engagement of the pressure roller 9 to remain substantially at a single point. Thus, any inadvertent incorrect vertical alignment of the pressure roller 9 does not have any noticeable effect on the pressure force; the more so as the thickened portion 7 can become deformed and provide a sufficient compensation.

We claim:

1. In a heat-insulated structural section assembly for window and door frames, consisting of an inner and an outer structural metal section transversely connected to each other by at least one plastic heat-insulating bar held in longitudinally extending opposite grooves of said structural sections, and at least one leg integral with one of said structural sections and extending generally parallel to the plane defined by the panel to be set in the window or door frame, said leg integrally extending from the terminal end of a flange partially defining the groove in said one structural section, and said groove-defining flange being forced under pressure by a pressure roller onto said heat-insulating bar, the groove-defining flange having a thickened portion which extends along the entire length of the structural section assembly, wherein the improvement comprises the feature that the thickened portion is located on the on the said leg on the side contacted by the pressure roller and facing away from said insulating bar.

* * * * *